US009149413B2

(12) United States Patent
Andersson et al.

(10) Patent No.: US 9,149,413 B2
(45) Date of Patent: Oct. 6, 2015

(54) PACKAGE

(75) Inventors: Peter Andersson, Norrköping (SE); Johan Werme, Norrköping (SE); Soheil Makdessi, Norrköping (SE)

(73) Assignee: A & R CARTON OY, Kauttua (FI)

( * ) Notice: Subject to any disclaimer, the term of this patent is extended or adjusted under 35 U.S.C. 154(b) by 0 days.

(21) Appl. No.: 14/239,656

(22) PCT Filed: Aug. 19, 2011

(86) PCT No.: PCT/SE2011/051001

§ 371 (c)(1),
(2), (4) Date: Jun. 4, 2014

(87) PCT Pub. No.: WO2013/028105

PCT Pub. Date: Feb. 28, 2013

(65) Prior Publication Data

US 2014/0305832 A1 Oct. 16, 2014

(51) Int. Cl.
*B65D 5/38* (2006.01)
*B65D 5/72* (2006.01)
(Continued)

(52) U.S. Cl.
CPC ... *A61J 1/03* (2013.01); *B65D 5/38* (2013.01); *B65D 5/70* (2013.01); *B65D 5/72* (2013.01); *B65D 5/728* (2013.01); *B65D 83/04* (2013.01); *B65D 2215/02* (2013.01)

(58) Field of Classification Search
CPC ..... A61J 1/03; B65D 5/38; B65D 5/70; B65D 5/723; B65D 83/04
USPC ..... 229/220, 125.125, 129.1, 185.1
See application file for complete search history.

(56) References Cited

U.S. PATENT DOCUMENTS 2,377,472 A * 6/1945 Murray ..... 229/125.12
2,426,911 A * 9/1947 Berg ..... 229/122
(Continued)

FOREIGN PATENT DOCUMENTS

DE 20302162 6/2004
EP 1 888 414 6/2010
(Continued)

OTHER PUBLICATIONS

International Search Report for PCT/SE2011/051001, mailed May 15, 2012.
(Continued)

*Primary Examiner* — Gary Elkins
(74) *Attorney, Agent, or Firm* — Nixon & Vanderhye P.C.

(57) ABSTRACT

A package (1) for containing loose items comprises at least one outer casing (2), at least one inner casing (3) accommodated slidably within the outer casing (2) and capable of motion between a closed configuration, in which an opening (4) presented by the inner casing (3) is concealed completely by the at least one outer casing (2), and an open configuration in which the opening (4) is exposed at least in part. The package (1) further comprises at least one connecting appendage (5) hinged along a first line to a side wall of the outer casing (2), and along a second line to a side wall of the inner casing (3) breasted in sliding contact with the side wall of the outer casing. The outer casing (2) comprises a locking part with a flap (6) folded to act against a corresponding locking part of the inner casing (3) also comprising a flap (7), both flaps (6, 7) in folded state being attached to the outer casing (2) and the inner casing (3), respectively. The two locking parts prevent immediate opening of the package from the closed configuration to the open configuration and wherein said part of the outer casing (2) is thicker than said part of the inner casing (3).

12 Claims, 2 Drawing Sheets

(51) Int. Cl.

| | |
|---|---|
| ***A61J 1/03*** | (2006.01) |
| ***B65D 5/70*** | (2006.01) |
| ***B65D 83/04*** | (2006.01) |

(56) References Cited

U.S. PATENT DOCUMENTS

| | | | | |
|---|---|---|---|---|
| 3,071,306 | A * | 1/1963 | Trethewey | 229/122 |
| 4,871,406 | A * | 10/1989 | Griffith | 156/82 |
| 5,275,291 | A | 1/1994 | Sledge | |
| 6,050,402 | A * | 4/2000 | Walter | 206/273 |
| 2003/0116614 | A1 * | 6/2003 | Block et al. | 229/146 |
| 2004/0188311 | A1 | 9/2004 | Paliota et al. | |
| 2005/0029336 | A1 | 2/2005 | Wende | |
| 2008/0156686 | A1 * | 7/2008 | Hluchan et al. | 206/528 |
| 2010/0059581 | A1 | 3/2010 | Ghini et al. | |
| 2011/0042375 | A1 * | 2/2011 | Jones et al. | 220/6 |
| 2011/0068039 | A1 | 3/2011 | Sack et al. | |
| 2013/0140201 | A1 * | 6/2013 | Ghini et al. | 206/267 |

FOREIGN PATENT DOCUMENTS

| | | |
|---|---|---|
| FR | 558924 | 9/1923 |
| FR | 764373 | 5/1934 |
| FR | 2693433 | 1/1994 |
| FR | 2850952 | 8/2004 |
| GB | 773129 | 4/1957 |
| WO | WO 2006/131830 | 12/2006 |
| WO | WO 2008/054305 | 5/2008 |

OTHER PUBLICATIONS

Written Opinion of the International Searching Authority for PCT/SE2011/051001, mailed May 15, 2012.

* cited by examiner

PACKAGE

This application is the U.S. national phase of International Application No. PCT/SE2011/051001, filed 19 Aug. 2011, which designated the U.S., the entire contents of which is hereby incorporated herein by reference.

FIELD OF THE INVENTION

The present invention relates to a package for containing loose items, comprising at least one outer casing, at least one inner casing accommodated slidably within the outer casing and capable of motion between a closed configuration, in which an opening presented by the inner casing is concealed completely by the at least one outer casing, and an open configuration in which the opening is exposed at least in part. The package further comprises at least one connecting appendage hinged along a first line to a side wall of the outer casing, and along a second line to a side wall of the inner casing breasted in sliding contact with the side wall of the outer casing.

BACKGROUND

Prior art discloses packages of a reclosable type consisting of a container of parallelepiped appearance that presents a base, and a set of side walls extending parallel to a longitudinal axis. The package is also furnished uppermost with a lid, hinged to the container and retained in the closed position by means of a tongue attached permanently to the selfsame container and designed to engage a lip presented by an inside face of the lid.

The products contained in such packages often cannot be dispensed satisfactorily, in particular small tablet-type items, given that with the lid in the open position, the size of the opening through with the contents are released is the same as the entire cross sectional area of the package.

In addition, the lid remains free to pivot on its hinge when open, and can impede the passage of the contents when shaken out of the pocket.

Finally, the tongue is easily defaced, so that the closure of the lid cannot be guaranteed of as long as the contents may remain in the package.

FR 2850952 discloses a package composed of two casings slidable one within another. The inner casing presents an opening of outline selected to suit the product, located in one side face, which is opened or closed by sliding the outer casing of the inner casing. The two casings are joined by a tear-off strip that must be removed in order to enable the sliding motion that opens the package. Finally, the two casings are interconnected by way of a common appendage associated with a bottom edge of the outer casing and with a bottom end face of the inner casing, serving as a travel limiter that prevents the two casings sliding entirely free of one another.

Once the tear-off strip has been removed, the two parts of the conventional package described briefly above remain free to slide as far as the travel limiting appendage will allow, and consequently it will often happen that when movement is induced in the package, for instance when in a garment pocket or a bag, the two parts extend one from another, far enough to expose the opening and allow the tablets or sweets to spill out accidentally.

In US 20050029336 another example is shown of a folding box that comprises an outer contour unit having outer wall elements connected via outer contour fold lines, a lid unit, a base unit, and a reclosable removal opening. A lower inner contour unit with lower inner wall elements connected via lower inner contour fold lines is folded inside the outer contour unit and connected to the outer contour unit via connecting fold lines. A polygonal upper inner contour inner unit having the removal opening and upper inner wall elements connected via upper inner contour fold lines is folded inside the outer contour unit. At least one connecting flap connects the lower and upper inner contour units and is folded inside the folding box. Folding or extending of the connecting flap allows relative displacement of the upper inner contour unit towards the outer contour unit.

A further example is disclosed in U.S. Pat. No. 5,275,291 showing a package for containing loose items. The package comprises at least one outer casing and at least one inner casing accommodated slidably within the outer casing and capable of motion between a closed configuration, in which an opening presented by the inner casing is concealed completely by the at least one outer casing, and an open configuration in which the opening is exposed at least in part. The package further comprises means interposed between the outer casing and the inner casing, by which to stabilize the inner casing in each of the two configurations.

For overcoming the above mentioned problems a solution is suggested in EP 1 888 414 where, apart from what is disclosed in U.S. Pat. No. 5,275,291, the stabilizing means comprise at least one connecting appendage hinged along a first line to a side wall of the outer casing, and along a second line to a side wall of the inner casing breasted in sliding contact with the side wall of the outer casing.

When used for items that should not be easily accessible for children, for instance medicine, there are requirements or guidelines as concerns child safety. No one of the above described packages provides for a package that is considered difficult for a child to open and at the same time has a simple construction.

SUMMARY OF THE INVENTION

The object of the present invention is therefore to provide a package that is considered to meet the requirements for a package to be more childproof.

This object is achieved by the package as set forth in the appended claims. A package is provided for containing loose items, comprising at least one outer casing, at least one inner casing accommodated slidably within the outer casing and capable of motion between a closed configuration, in which an opening presented by the inner casing is concealed completely by the at least one outer casing, and an open configuration in which the opening is exposed at least in part. The package further comprises at least one connecting appendage hinged along a first line to a side wall of the outer casing, and along a second line to a side wall of the inner casing breasted in sliding contact with the side wall of the outer casing. The outer casing comprises a locking/stopping part with a flap folded to act against a corresponding locking/stopping part of the inner casing also comprising a flap, both flaps in folded state being attached to the outer casing and the inner casing, respectively.

The two locking parts prevent immediate opening of the package from the closed configuration to the open configuration and wherein said part of the outer casing is thicker than said part of the inner casing. By making the locking part of the outer casing thicker, the service life of the locking function is increased. Also, the locking function itself is positively affected by the thicker locking part. A package of this type with a childproof function could for instance be used for nicotine chewing gums. A package could typically hold up to 30 pieces. With a locking part of the outer casing being equally thick as the flap, the childproof function will not last 30 openings. By increasing the thickness of the locking part of the outer casing the number of openings with maintained childproof function increases considerably.

According to one alternative embodiment of the package the locking part of the outer casing is made up by a flap folded twice to make it thicker. The obvious advantage is of course that no additional part is necessary, however, the requirements on the machines producing the packages will increase. Instead of folding the flap twice the locking part of the outer casing could comprise an additional part. For instance, a self adhesive part could be attached to make the flap thicker.

Preferably, the inner casing and the outer casing is made from one sheet. In a preferred embodiment the inner casing and the outer casing are connected to each other only via the connecting appendage.

According to one aspect of the invention the opening comprises four sides and has a flap hinged to one of its sides. A way of finding out whether or not a package has been previously opened, i.e. that items contained in the package has been removed or replaced, is to have a flap which is perforated on three out of four sides and hinged on the fourth side. This only works once but for certain applications it is essential to have this function. Preferably, the flap at the opening is hinged to the side of the opening closest to the end of the inner casing. This facilitates the removal of objects stored in the package. Further, the length of the opening flap perpendicular to the hinge is longer than the distance between the hinge and the end of the inner casing. The flap can in this way more easily be pushed inwardly until it touches the inside end of the inner casing and thereby minimizing the risk of anything getting stuck behind the flap of the opening.

According to yet another aspect of the present invention the width of the opening flap is equal to the width of the inner casing. When the opening flap is pushed inwards, the flap helps stabilizing the whole package and thus also increases the lifetime of the safety function. The flap will also stay in the same open position which is an advantage since it will not close inadvertently.

Preferably, the outer casing has a hinged flap in a position corresponding to the position of the flap of the inner casing when the package is in the closed position. Especially if the flap of the locking part is made particularly thick a flap on the outer casing is necessary in order for the package to be opened at all, at least according to the intended function of the invention.

In a preferred embodiment the package comprises carton board with a weight between 200 $g/m^2$ and 400 $g/m^2$. For a standard size package holding for instance 20 to 30 tablet like items this board weight has proved to function well with the ideas of the present invention. Also, preferably the carton board is covered at least on one side with a PET having a thickness between 10 μm and 100 μm. Apart from protecting the carton the PET helps increasing the strength of the adhesive bond.

For increased smoothness when opening and closing a package according to the present invention the connecting appendage could comprise at least one crease. The connecting appendage is bent every time the package is opened/closed and by having a crease the bending is facilitated and thus also the opening and closing of the package.

BRIEF DESCRIPTION OF FIGURES

The package according to the present invention is explained below in more detail with reference to the figures.

DISCLOSURE OF PREFERRED EMBODIMENTS

The package according to the invention will be explained with reference made to the enclosed figures. The examples are chosen in order to facilitate the reading and understanding of the inventive concept.

Figure 1:
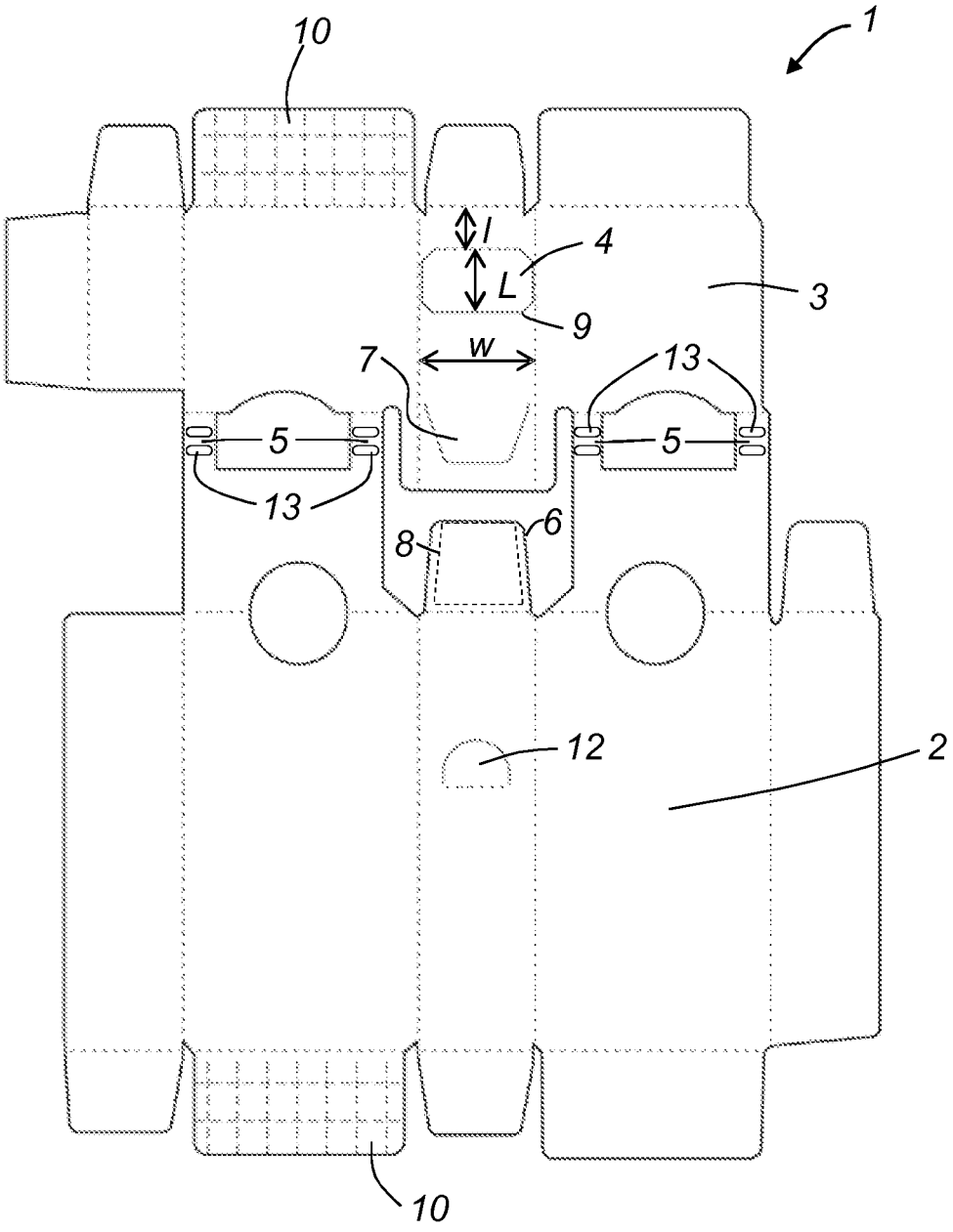
FIG. 1 shows a package according to one embodiment in an unfolded state.

FIG. 1 shows a package 1 in an unfolded state according to the present invention. The package 1 has an outer casing 2 and an inner casing 3. The inner casing 3 further has an opening 4 through which the contents of the package 1 is supposed to be taken. The inner casing 3 and the outer casing 2 are connected to each other with the connecting appendage 5. The outer casing 2 has a flap 6 which is bent inwards and the inner casing 3 has a flap 7 bent outwards. Both flaps 6 and 7 are kept in a folded state being attached to its respective casing 2, 3 with for instance an adhesive. The flap 6 of the outer casing 2 has in the shown embodiment an additional piece 8 of carton material. Thus, the flap 6 of the outer casing 2 together with the additional piece 8 make up the thicker locking part of the package 1.

Further, in the embodiment shown in FIG. 1 the opening 4 of the inner casing 3 is equipped with a flap 9 which is hinged in its upper side. The length L of the flap and the length I between the upper side of the opening 4 and the end of the package are such the L>I. When the package 1 is opened for the first time the flap 9 is pushed inwards. Because of said length ratio, i.e. L>I, the flap 9 cannot be pushed to lie flat against the inside of the inner casing side wall. Also, because of the width w of the flap 9 being essentially the same as the inside width of the inner casing 3, the flap 9 stays in the position it reaches when pushed into the inner casing 3. The flap 9 stays in a position due to friction. A further advantage of the width w being more or less equal to the inside width of the inner casing 3 is that it helps stabilizing the package 1 and thereby also the function of the locking parts. The ends of the package in finished state are denoted with 10 in FIG. 1.

For opening the package the flap 12 visible on the outside of the outer casing 2 should be pressed in when the package 1 is in the closed position, i.e. when the inner casing 3 is contained within the outer casing 2 (apart from the upper end). When the flap 12 is pressed inwards it pushes against the flap 7 of the inner casing 3. If the force used to press the flap 12 exceeds a specific threshold the flap 7 of the inner casing 3 is pushed far enough to be able to pass the flap 6 of the outer casing 2.

When the inner casing 3 is pulled out of the outer casing 2 the creases 13 of the connecting appendage 5 facilitates the movement. With the creases 13 the resistance is decreased and this also applies when the inner casing 3 is being pushed back into the outer casing 2.

Figure 2:
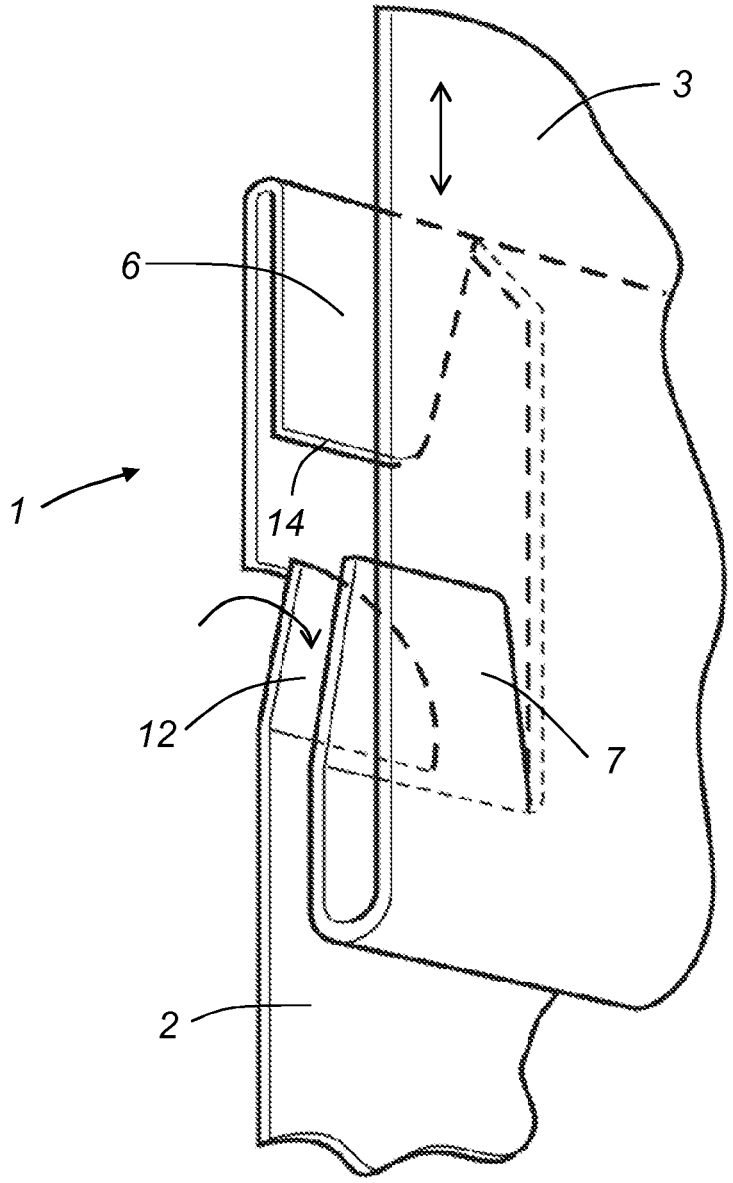
FIG. 2 shows schematically the principle of the opening process of a package according to the present invention.

FIG. 2 is a figure for showing the principle of opening the package 1. When the flap 12 is pressed inwards it pushes against the flap 7 of the inner casing 3. If the force used to press the flap 12 exceeds a specific threshold the flap 7 of the inner casing 3 is pushed far enough to be able to pass the flap 6 of the outer casing 2. For the package 1 to open the inner casing 3 simultaneously with the above pressing must be pulled out of the outer casing 3. The threshold is simply the force needed to push the flap 12 such that the flap 7 of the inner casing is allowed to pass the edge 14 of the first flap 6 of the outer casing 2. Preferably, the flap 6 of the outer casing 2 is according to the present invention thicker than just the thickness of the material. This thicker flap 6 (not shown to be thicker in FIG. 2) thus allows for a longer lifetime as regards number of times the package 1 can be opened. If the flap 6 is not made thicker the package 1 can be opened just by pulling the inner casing 3 out of the outer casing 2 after just a couple of times since the edge 14 will fast be worn.

The foregoing is a disclosure of an example practicing the present invention. However, it is apparent that method incorporating modifications and variations will be obvious to one skilled in the art. Inasmuch as the foregoing disclosure is intended to enable one skilled in the art to practice the instant invention, it should not be construed to be limited thereby, but should be construed to include such modifications and variations as fall within the scope of the claims. For instance, instead of having a hinged flap for the outer casing, some kind of printing could be made on the carton to mark the spot where a user should press in order to open the package. Further, instead of creases it would be possible to use some other kind of treatment of the carton, for instance dots of Braille type. Also, other carton board weights could be considered outside the above range of 200 g/m$^2$ to 400 g/m$^2$, at the time of filing this application the range is considered to be the most appropriate. The same goes for the thickness of the PET-layer which now is written to be preferred to be within the range between 10 μm and 100 μm. Also, the package material should not be considered to be limited to carton board. New materials are being continuously developed and for instance a hybrid material made from paper and plastics would likely work just as well with the inventive idea.

The invention claimed is:

1. A package for containing loose items comprising:

at least one outer casing, at least one inner casing accommodated slidably within the outer casing and capable of motion between a closed configuration, in which an opening presented by the inner casing is concealed completely by the at least one outer casing, and an open configuration in which the opening is exposed at least in part, at least one connecting appendage hinged along a first line to a side wall of the outer casing, and along a second line to a side wall of the inner casing breasted in sliding contact with the side wall of the outer casing, wherein the outer casing comprises a first locking part with an inwardly folded flap and the inner casing comprises a second locking part with an outwardly folded flap, and wherein the inwardly folded flap of the first locking part includes an additional part which increases a thickness of the inwardly folded flap, wherein both the inwardly folded and outwardly folded flaps are in folded state and attached to a corresponding portion of the outer casing and the inner casing, respectively, and wherein the first locking part with the inwardly folded flap having an increased thickness provided by the additional part acts against the outwardly folded flap of the second locking part to thereby prevent immediate opening of the package from the closed configuration to the open configuration.

2. A package according to claim 1, wherein the first locking part of the outer casing comprises a flap which is folded twice.

3. A package according to claim 1, wherein the additional part is self-adhesive.

4. A package according to claim 1, wherein each of the inner casing and the outer casing is made from one sheet.

5. A package according to claim 1, wherein said opening comprises four sides and has an opening flap hinged to one of its sides.

6. A package according to claim 5, wherein the opening flap is hinged to a side of the opening closest to an end of the inner casing.

7. A package according to claim 6, wherein the opening flap has a length (L) perpendicular to the hinge which is longer than a distance (I) between the hinge and the end of the inner casing.

8. A package according to claim 5, wherein the opening flap has a width (w) which is equal to a width of the inner casing.

9. A package according to claim 1, wherein the outer casing has a hinged flap in a position corresponding to the position of the outwardly folded flap of the inner casing when the package is in the closed position.

10. A package according to claim 1, wherein the package comprises carton board with a weight between 200 g/m$^2$ and 400 g/m$^2$.

11. A package according to claim 10, wherein the carton board is covered at least on one side with a layer of polyethylene terephthalate (PET) having a thickness between 10 μm and 100 μm.

12. A package according to claim 1, wherein the connecting appendage comprises at least one crease to facilitate the sliding movement between the inner and outer casings.

* * * * *